US009499759B2

(12) United States Patent
Kim et al.

(10) Patent No.: US 9,499,759 B2
(45) Date of Patent: Nov. 22, 2016

(54) PAPER-BASED WET FRICTION MATERIAL OF AUTOMOTIVE AUTO TRANSMISSION

(71) Applicants: HYUNDAI MOTOR COMPANY, Seoul (KR); JINMYUNG FRICTECH CO., LTD., Incheon (KR)

(72) Inventors: Yoon Cheol Kim, Suwon-si (KR); Eun Pa Cho, Bucheon-si (KR); Young Taek Oh, Seoul (KR); Sung Jin Hong, Incheon (KR)

(73) Assignees: Hyundai Motor Company, Seoul (KR); Jinmyung Frictech Co., Ltd., Incheon (KR)

( * ) Notice: Subject to any disclaimer, the term of this patent is extended or adjusted under 35 U.S.C. 154(b) by 85 days.

(21) Appl. No.: 14/673,848

(22) Filed: Mar. 30, 2015

(65) Prior Publication Data

US 2016/0160146 A1 Jun. 9, 2016

(30) Foreign Application Priority Data

Dec. 9, 2014 (KR) ..... 10-2014-0176158

(51) Int. Cl.

*C10M 111/04* (2006.01)
*C10M 169/04* (2006.01)
*C10M 177/00* (2006.01)

(52) U.S. Cl.

CPC ..... *C10M 111/04* (2013.01); *C10M 169/041* (2013.01); *C10M 177/00* (2013.01); *C10M 2201/041* (2013.01); *C10M 2201/0413* (2013.01); *C10M 2201/102* (2013.01); *C10M 2201/1023* (2013.01); *C10M 2209/12* (2013.01); *C10M 2209/123* (2013.01); *C10M 2217/044* (2013.01); *C10M 2217/0443* (2013.01); *C10N 2230/06* (2013.01); *C10N 2230/76* (2013.01); *C10N 2240/042* (2013.01); *C10N 2250/14* (2013.01)

(58) Field of Classification Search

CPC ..... C10M 111/04; C10M 169/041; C10M 177/00; C10M 2201/041; C10M 2201/0413; C10M 2201/102; C10M 2201/1023; C10M 2209/12; C10M 2209/123; C10M 2217/044; C10M 2217/0443; C10N 2230/06; C10N 2230/76; C10N 2240/042; C10N 2250/14

See application file for complete search history.

(56) References Cited

U.S. PATENT DOCUMENTS 5,585,166 A * 12/1996 Kearsey ..... F16D 65/123 188/106 R
7,696,261 B2 4/2010 Lam

FOREIGN PATENT DOCUMENTS

JP 2000-161406 A 6/2000
JP 2007-246590 A 9/2007
KR 10-2000-0016905 A 3/2000

OTHER PUBLICATIONS

Korean Office Action issued in Korean Application No. 10-2014-0176158 dated Nov. 16, 2015.

*Primary Examiner* — Cephia D Toomer
(74) *Attorney, Agent, or Firm* — McDermott Will & Emery LLP

(57) ABSTRACT

A multilayer paper-based wet friction material of an automotive auto transmission may improve noise and vibration characteristics, heat resistance, wear resistance, compression resistance, and oil absorbency. The paper-based wet friction material of an automotive auto transmission includes: a first layer using cellulose pulp as a matrix and including a first functional additive; a second layer stacked on the first layer, using the cellulose pulp as the matrix, and including the second functional additive; and a hydrogen bonding layer mediating between the first layer and the second layer. The cellulose pulp of the first and second layers is cotton linter.

5 Claims, 4 Drawing Sheets

| | | Diatomite 15% | Diatomite 30% |
|---|---|---|---|
| | | $d_{50}/dv$ | $d_{50}/dv$ |
| LVFA TEST (0hr) | 40℃ | 0.3 | 4.1 |
| | 80℃ | -1.1 | 3.0 |
| | 120℃ | -5.7 | 5.9 |
| LVFA TEST (24hr) | 40℃ | 3.4 | 8.3 |
| | 80℃ | 1.6 | 6.2 |
| | 120℃ | -3.8 | 2.8 |
| LVFA TEST (48hr) | 40℃ | 3.5 | 7.9 |
| | 80℃ | 1.5 | 5.5 |
| | 120℃ | 0.4 | 4.5 |

<Diatomite 15%>

<Diatomite 30%>

PAPER-BASED WET FRICTION MATERIAL OF AUTOMOTIVE AUTO TRANSMISSION

CROSS REFERENCE TO RELATED APPLICATION

The present application claims priority to Korean Patent Application No. 10-2014-0176158, filed on Dec. 9, 2014 in the Korean Intellectual Property Office, the entire contents of which is incorporated herein in its entirety by reference.

BACKGROUND OF THE INVENTION

1. Technical Field

The present invention relates to a paper-based wet friction material of an automotive auto transmission, and more particularly, to a paper-based wet friction material of an automotive auto transmission which is formed in a multi-layer to improve noise and vibration characteristics, heat resistance, wear resistance, compression resistance, and oil absorbency.

2. Description of the Related Art

A clutch of a transmission used as a power transfer means of a vehicle is classified into a manual type and an auto type depending on a system.

The manual type has a function of a dry contact mechanism using a part which regulates power of an engine, while the auto type has a hydraulic torque converter and a wet contact mechanism using transmission oil within a trans/trans axle which is used for regulating and controlling power.

In North America, most vehicles use an automotive auto transmission and large vehicles such as truck and bus increasingly use the automotive auto transmission. The use of the automotive auto transmission is suddenly spreading as the use of vehicles is suddenly increased and a quality of vehicles is improved.

A paper disc which is used as a clutch part of the automotive auto transmission needs to be excellent in physical properties such as friction and abrasion properties, durability, and impregnation porosity. In particular, the clutch of the automotive auto transmission is operated within the transmission oil, and therefore needs to have high friction property, wear resistance, durability, and the like even at high temperature.

Until now, as a wet clutch material, paper, sintered copper (sintered Cu), resin, graphite, and the like have been used, but as a friction material for vehicles, paper mainly tends to be used.

The paper disc is made of an inorganic filler, a thermosetting resin (phenol, epoxy, melamine resin), and the like, using pulp as the basis, in which it has been known that a kind and an added amount of inorganic filler have a great effect on the friction property of the paper disc.

However, the paper disc is expensive and does not satisfy friction property, wear resistance, durability, and the like at a high temperature. Therefore, a necessity for development of a paper disc which solves the above problem has been increased.

SUMMARY OF THE INVENTION

An object of the present invention is to provide a paper-based wet friction material of an automotive auto transmission capable of saving manufacturing costs while improving noise and vibration characteristics, heat resistance, wear resistance, compression resistance, and oil absorbency together.

According to an exemplary embodiment of the present invention, there is provided a paper-based wet friction material of an automatic auto transmission, including: a first layer using cellulose pulp as a matrix and including a first functional additive; a second layer stacked on the first layer, using the cellulose pulp as the matrix, and including the second functional additive; and a hydrogen bonding layer mediating between the first layer and the second layer, wherein the cellulose pulp of the first and second layers is cotton linter.

The first functional additive may include aramid fiber and a content of the aramid fiber may be equal to or less than 10 wt % (except for 0).

The second layer may have the cellulose pulp of which the content is equal to or less than 10 wt % (except for 0).

The second functional additive may include diatomite and a content of the diatomite may be equal to or more than 30 wt %.

The second functional additive may include aramid fiber and carbon fiber.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

Figure 1:
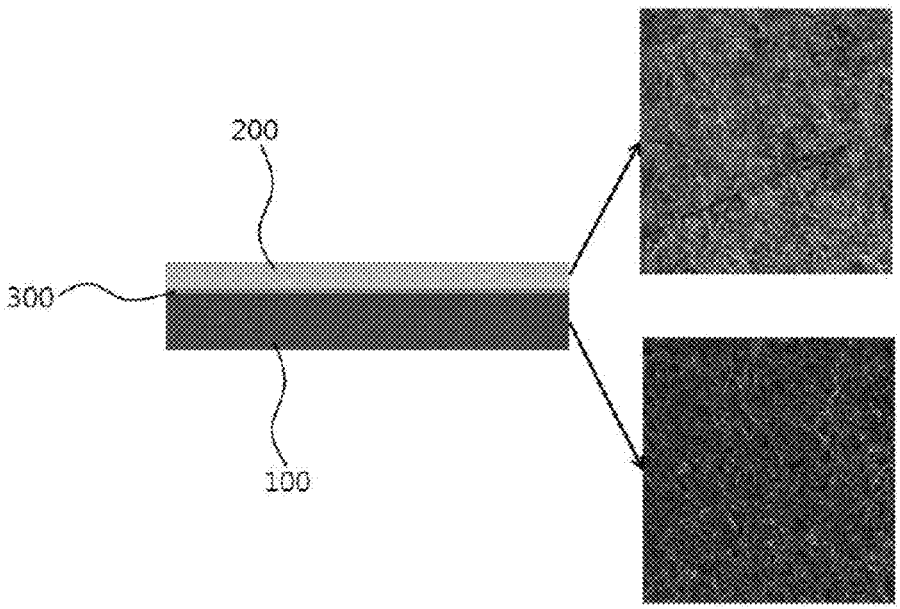
FIG. 1 is a diagram illustrating a paper-based wet friction material of an automotive auto transmission according to an exemplary embodiment of the present invention.

Hereinafter, exemplary embodiments of the present invention will be described in detail with reference to the accompanying drawings. However, the present invention is not limited to these exemplary embodiments. For reference, the reference numerals will be used to describe substantially the same components. Under this rule, a description may be provided while citing a content shown in other drawings and a content well-known to those skilled in the art or a repeated content may be omitted.

FIG. 1 is a diagram illustrating a paper-based wet friction material of an automotive auto transmission according to an exemplary embodiment of the present invention.

As illustrated in FIG. 1, the paper-based wet friction material of an automotive auto transmission according to the exemplary embodiment of the present invention includes a first layer 100, a second layer 200 stacked on the first layer 100, and a hydrogen bonding layer 300 disposed between the first and second layers 100 and 200 to mediate between the first and second layers 100 and 200.

The first layer 100 and the second layer 200 use cellulose pulp as a matrix and are added with a first functional additive and a second functional additive and thus reformed to meet each required characteristic.

In this case, as the cellulose pulp, cotton linter may be used. The reason is that the hydrogen bonding layer may be formed using an O—H pulp structure contained in cotton linter.

The first and second functional additives are formed of reinforcing fiber, lubricants, friction modifiers, fillers, and the like, depending on a role thereof.

The first layer 100 is added with, as the first functional additive, aramid fiber containing fibrillation having a cross linking effect while increasing a content of the cotton linter which is used as the matrix to improve the compression resistance.

The aramid fiber is reinforcing fiber and serves to reinforce the matrix, thereby improving the compression resistance.

Further, the aramid fiber may improve oil absorbency.

Figure 2A:
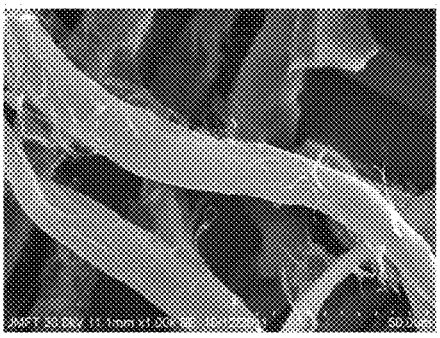
FIG. 2A is a photograph of cotton linter and FIG. 2B is a photograph of the cotton linter in which aramid fiber is contained.
Figure 2B:
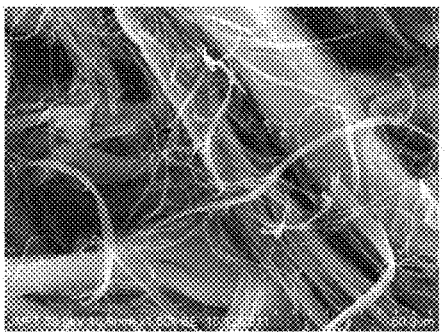

FIG. 2A is a photograph of cotton linter and FIG. 2B is a photograph of the cotton linter in which an aramid fiber is contained.

As illustrated in FIGS. 2A and 2B, when the cotton linters contain the aramid fiber, spaces between the cotton linters serve as a pocket which may absorb oil, thereby improving the oil absorbency.

In this case, a content of the aramid fiber may be limited to 10 wt % or less. The reason is that the content of expensive aramid fiber is optimized and thus manufacturing costs may be saved.

The first functional additive according to the exemplary embodiment of the present invention may include diatomite as a filler.

Since the diatomite itself is provided with a plurality of pockets, when the diatomite is used as the filler, an oil pocket is sufficiently secured and thus the oil absorbency may be improved.

Meanwhile, to improve elasticity of the first layer 100, the first functional additive may be added with nitrile rubber, and the like as the friction modifier.

The second layer 200 uses the cellulose pulp as the matrix and is added with the second additive to meet the required characteristics.

In this case, similar to the first layer 100, the second layer 200 uses the cotton linter as the matrix, in which the content of the cotton linter may be limited to 10 wt % or less.

Figure 3:
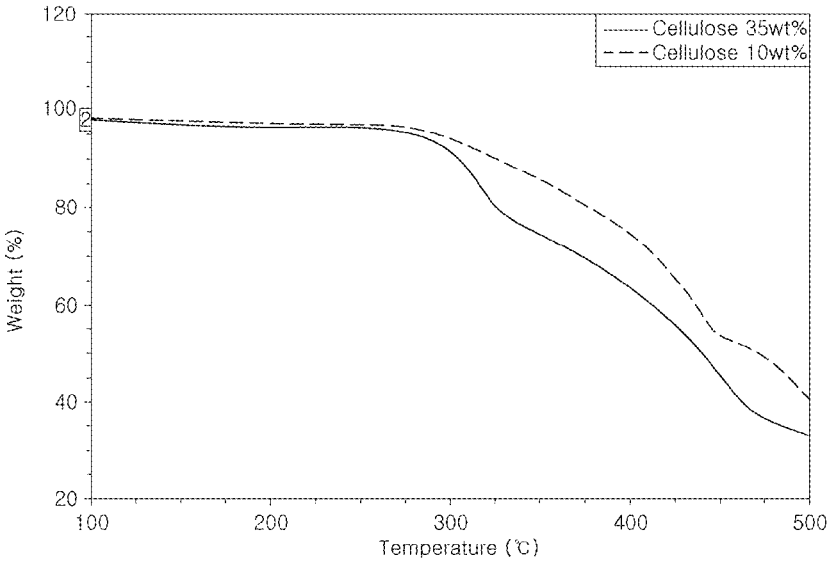
FIG. 3 is a graph illustrating a relationship between content and heat resistance of cellulose contained in a second layer according to an exemplary embodiment of the present invention.

FIG. 3 is a graph illustrating a relationship between content and heat resistance of cellulose contained in a second layer according to an exemplary embodiment of the present invention.

As illustrated in FIG. 3, it may be appreciated from a test result of heat resistance characteristics that as the content of the cotton linter contained in the second layer 200 according to the exemplary embodiment of the present invention is increased, the heat resistance deteriorates but when the content of the cotton linter is reduced to about 10 wt %, the heat resistance is improved.

Meanwhile, since the second layer 200 requires the high heat resistance and wear resistance, the second layer 200 needs to include a large amount of reinforcing fiber such as aramid fiber and carbon fiber as the second functional additive. As the result, the usage of the cotton linter is reduced in proportion to the increasing amount of reinforcing fiber.

According to the exemplary embodiment of the present invention, the second functional additive may be added with diatomite as a filler of 30 wt % or more. Therefore, a surface may be smoothed and the noise and vibration characteristics may be improved.

Figure 4:
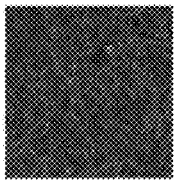
FIG. 4 is a diagram illustrating noise and vibration characteristics depending on a content of diatomite contained in the second layer according to the exemplary embodiment of the present invention.
Figure 4:
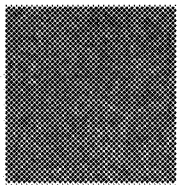

FIG. 4 is a diagram illustrating the noise and vibration characteristics depending on the content of the diatomite contained in the second layer 200 according to the exemplary embodiment of the present invention. To evaluate the noise and vibration characteristics, low velocity friction apparatus (LVFA) evaluation which is an international test standard is performed. In this case, friction stability was evaluated with a $d\mu/dv$ value which is derived by the LVFA evaluation.

In this case, when the slope $d\mu/dv$ of friction coefficient to velocity has a positive (+) value, a stick-slip does not occur and thus the noise and vibration characteristics are excellent. When the slope $d\mu/dv$ has a negative (−) value, the occurrence of the stick-slip is increased and thus the noise vibration characteristics deteriorate.

According to the exemplary embodiment of the present invention, when the second functional additive contains the diatomite of 30 wt % or more, it may be appreciated that the noise and vibration characteristics are improved.

Meanwhile, the second functional additive may further include the friction modifier such as coke and graphite and thus the noise and vibration characteristics may be further improved.

Figure 5:
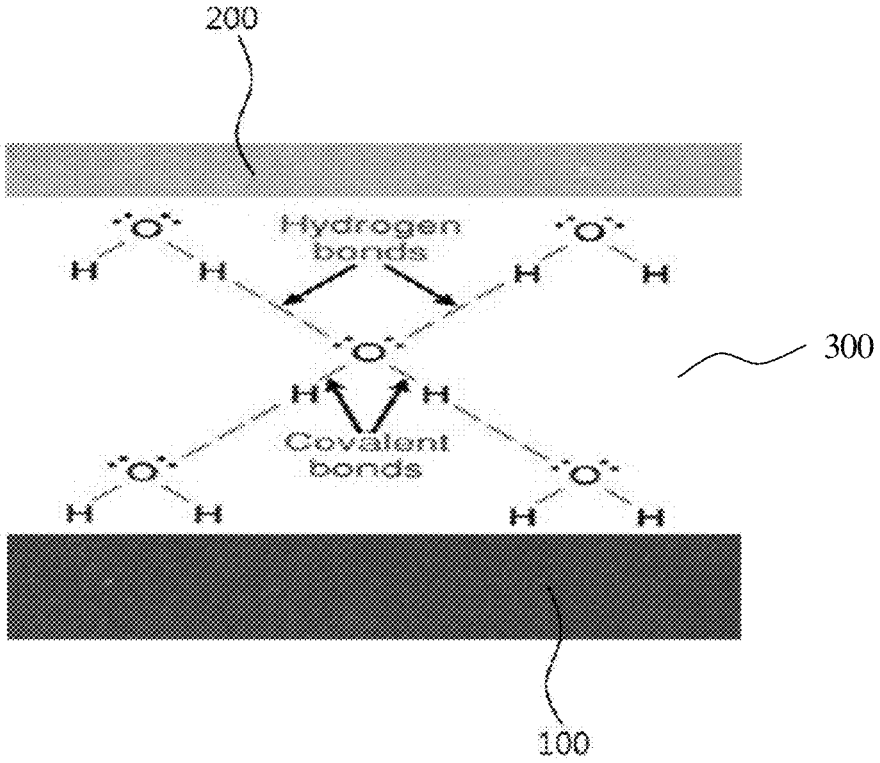
FIG. 5 is a diagram for describing a hydrogen bonding layer according to an exemplary embodiment of the present invention.
Figure 6:
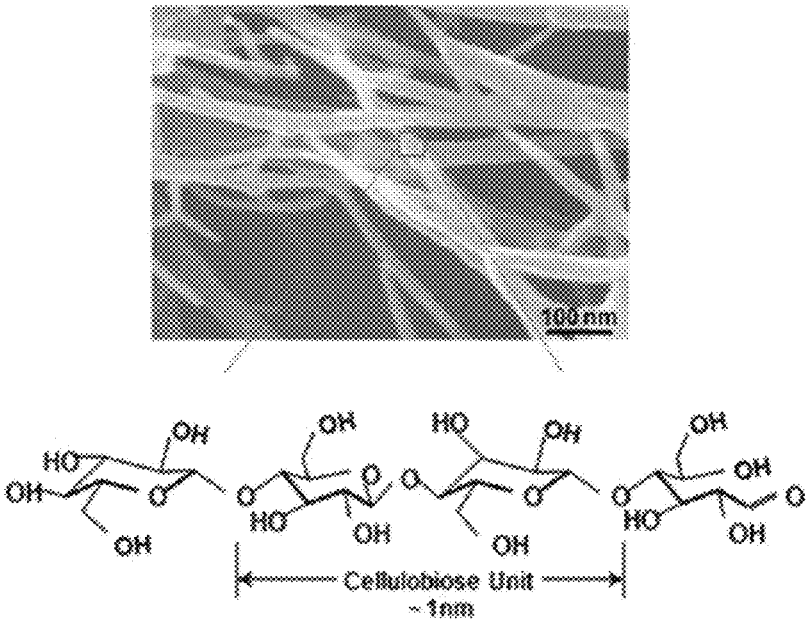
FIG. 6 is a diagram illustrating an O—H pulp structure included in the first and second layers according to the exemplary embodiment of the present invention.

FIG. 5 is a diagram for describing the hydrogen bonding layer according to an exemplary embodiment of the present invention and FIG. 6 is a diagram illustrating the O—H pulp structure included in the first and second layers according to the exemplary embodiment of the present invention.

As illustrated in FIGS. 5 and 6, the first layer 100 and the second layer 200 according to the exemplary embodiment of the present invention are coupled with each other via the hydrogen bonding layer 300.

As described above, the first and second layers 100 and 200 both use the cotton linter as the matrix and include the O—H structure.

Therefore, when moisture ($H_2O$) is penetrated into the first and second layers, the hydrogen bond may be made with the O—H structure and moisture ($H_2O$) which are included in both of the first and second layers and then the hydrogen bonding layer 300 which couples the first layer 100 with the second layer 200 may be formed by dewatering press, drying, impregnation, curing, and the like.

Therefore, according to the paper-based wet friction material of an automatic auto transmission according to the exemplary embodiment of the present invention, the existing wet friction material of a single layer, which may not simultaneously satisfy NVH, wear resistance, compression resistance, service life, and the like, is divided into a multilayer and is added with the functional additive to satisfy the characteristics required in each layer and the plurality of layers are coupled with each other via the hydrogen bonding layer to simultaneously improve the noise and vibration characteristics, the heat resistance, the wear resistance, the compression resistance, and the oil absorbency.

Further, the second layer 200 (friction surface) is provided with the expensive friction material which is advantageous in noise/vibration and heat generation and the first layer 100 (adhesive surface) is provided with a relatively cheap friction material which is advantageous in the increase in compression resistance and lubrication, thereby saving the manufacturing costs.

According to the exemplary embodiments of the present invention, it is possible to simultaneously improve the noise and vibration characteristics, the heat resistance, the wear resistance, the compression resistance, and the oil absorbency by forming the friction material in the multilayer and optimizing the component mixing ratio to meet the required characteristics of each layer.

Further, it is possible to save the manufacturing costs by preventing unnecessary element materials from being added to each layer.

As described above, although the present invention has been described with reference to the exemplary embodiments thereof, those skilled in the art will appreciate that various modifications and alteration may be made without departing from the scope and spirit of the invention as disclosed in the accompanying claims.

What is claimed is:

1. A paper-based wet friction material of an automatic auto transmission, comprising:

a first layer using cellulose pulp as a matrix and including a first functional additive;

a second layer stacked on the first layer, using the cellulose pulp as the matrix, and including a second functional additive; and a hydrogen bonding layer mediating between the first layer and the second layer, wherein the cellulose pulp of the first and second layers is cotton linter.

2. The paper-based wet friction material of claim 1, wherein the first functional additive includes aramid fiber and a content of the aramid fiber is equal to or less than 10 wt % (except for 0).

3. The paper-based wet friction material of claim 1, wherein the second layer has the cellulose pulp of which a content is equal to or less than 10 wt % (except for 0).

4. The paper-based wet friction material of claim 1, wherein the second functional additive includes diatomite and a content of the diatomite is equal to or more than 30 wt %.

5. The paper-based wet friction material of claim 1, wherein the second functional additive includes aramid fiber and carbon fiber.

* * * * *